United States Patent [19]

Cutler

[11] Patent Number: 4,729,276

[45] Date of Patent: Mar. 8, 1988

[54] AUXILIARY SNAP-ON KEY EXTENDERS FOR MUSICAL KEYBOARDS

[76] Inventor: Douglas A. Cutler, General Delivery, Haliburton, Ontario, Canada, KOM1S0

[21] Appl. No.: 4,884

[22] Filed: Jan. 20, 1987

[51] Int. Cl.[4] ..... G10C 3/12

[52] U.S. Cl. ..... 84/425; 84/453

[58] Field of Search ..... 84/230–232, 84/358, 423–427, 433, 437, 443, 453, 479 A

[56] References Cited

U.S. PATENT DOCUMENTS

| | | | |
|---|---|---|---|
| 334,484 | 1/1886 | Stewart | 84/425 X |
| 2,627,777 | 2/1953 | Robbins | 84/423 A |
| 3,022,698 | 2/1962 | Lucas | 84/423 A |
| 3,392,620 | 7/1968 | Thompson | 84/425 |
| 3,616,723 | 11/1971 | Gullickson | 84/485 X |
| 4,658,695 | 4/1987 | Cutler | 84/424 |

*Primary Examiner*—Lawrence R. Franklin

[57] ABSTRACT

A set of vertically extended, auxiliary snap-on keys clip onto a conventional keyboard's keys, elevating the plane of the keyboards. The auxiliary keys have the same width as their host keys but are shorter. The auxiliary keys permit two keyboards to be placed closer to each other, facilitating playing of them with one hand.

2 Claims, 16 Drawing Figures

AUXILIARY SNAP-ON KEY EXTENDERS FOR MUSICAL KEYBOARDS

This invention relates generally to musical keyboard instruments and more specifically to improvements in providing close proximity auxiliary keyboards for existing keyboard instruments.

The invention consists of a set of vertically extended auxiliary snap on keys for musical keyboard instruments that in effect, upwardly extend the touchplate surfaces of their host keyboard. The keys of the invention have the same lateral mensuration as their host keys, however they are significantly shorter than the latter. When the keys of the invention are installed on a suitable host keyboard instrument, (i.e. one with a flat overall design and a compact shell height) a second non-hosting keyboard can then be brought into the arrangement. The result is a close proximity step-like configuration of keyboards such that one hand alone can comfortably span both keyboards.

The invention herein disclosed, represents a more simplifed approach to achieving the same goals as laid out in my prior patent, A MULTI-DECKED KEYBOARD FOR MUSICAL INSTRUMENTS, Ser. No. 776,888, filed 9/17/85 now U.S. Pat. No. 4,658,695.

The prior art contains many inventions whose goal it is to create multiple close proximity keyboard arrangements with various levels that are easily spanned by a single hand. In all cases however, these inventions involve constructing new types of structures suited specifically to that purpose, complete with a minimum combination of keys, mechanical actuators and housing structures thereof. This is true even in cases where additional key levels are created by adding on a close proximity auxiliary keyboard to an already existing keyboard.

The goal of this invention then, is to create an arrangement of two or more close proximity keyboards that are simultaneously accessible by one hand alone, while at the same time, avoiding complete construction of a new keyboard.

Various contemporary electronic musical keyboard instruments are of a very compact design, having an overall shell height of as little as three inches or less in many cases. In addition, they are commonly constructed in such a way that their control consoles are horizontally set on a plane that is level with, or only an inch or two above the plane of their touchplate surfaces.

When the keys of the invention are in place on such a keyboard instrument they provide a new keyboard, directly connected to the old one that will be a few inches above the level of the original keyboard of the host instrument. Thus the keys of the invention, once in place, provide a new keyboard area with a sharp vertical drop of a few inches along its rearward edge.

At this point it is possible to physically introduce a second keyboard instrument so that its keyboard surface is immediately behind, and slightly above, the rear of the keyboard created by the keys of the invention. As a result a close proximity double decked keyboard that is easily spanned by one hand is achieved.

It should be added, that this non-hosting upper keyboard will ideally be of a type of construction that puts the front of its keys extremely close to or even with, the front edge of its housing structure. Fortunately, most of the same keyboard instruments already mentioned include this design.

The basic principle of the invention may also be applied to keyboard instruments with somewhat higher housing structures than those mentioned above. For example, a compact keyboard instrument could be suspended beneath the keybed of a piano with the keys of the former exposed outwardly from the front edge of the piano. A higher version of the vertically extended snap-on keys could then make up the vertical distance between the host keyboard and the piano keyboard.

In cases where higher extenders are used they may add unacceptable weight to the front part of their host keys, consequently imbalancing the levers of the latter. As a result some counter-weighting adjustments may have to be made at the rear of actuating levers of the host keyboard in order to ensure proper functioning of the action in that keyboard. This can be accomplished with the installment of lead weights or extra springs and should be possible in most cases.

Otherwise the keys of the invention, as they are used in conjunction with host keyboards, should not deface those keyboards during installation or removal nor should they interfere with the normal functioning of those instruments at any point. In addition, the keys of the invention once installed should be so secured to their host keys that they do not come loose during use.

Various devices in the prior art involve removable means of attachment, whereby altered keys are positionable on top of existing keyboards. However, the differing key shapes of these inventions do not provide, nor do they aim to achieve, the function of the herein disclosed invention, which is to connect two keyboards together such that one hand can easily and simultaneously access both.

The benefits to the performer of a multi-leveled close proximity keyboard arrangement are many. The number of independent pitch locations accessible with only slight movements of the hand are greatly increased. When the host keyboard instrument is interfaced with appropriate computer hardware and software its keys can be assigned pitches in various ways that differ widely from the chromatic linear pitch assignments of standard keyboards. Many new techniques for playing chords, scales, and arpeggios etc. will result without disturbing the familiar chromatic pitch configuration of the non-hosting upper keyboard.

By employing two or more separate sets of auxiliary key extenders, three or more suitable keyboards can be brought into an expanded multi-leveled close proximity keyboard arrangement wherein a single hand can easily span various levels.

Other objects and structural details of the invention will be apparent from the following desription when read in conjunction with the accompanying drawings forming part of this specification.

In reference to the drawings

FIG. 1*a* shows a perspective view of the keys of the invention in place on an underlying host keyboard and positioned in close proximity to an upper keyboard.

FIG. 1*b* shows the same perspective view as in FIG. 1*a* except the keys of the invention are removed from the stacked arrangement of two compact keyboards.

FIG. 2 shows individual keys of the invention in perspective view. Here they are both attached and unattached to their corresponding host keys.

FIG. 3*a* is a side view of the black keys of the invention both attached and unattached to the underlying host keyboard.

FIG. 3*b* is a side view of the white keys of the invention both attached and unattached to the underlying host keyboard.

FIG. 3*c* is a side view of the keys of the invention both black and white attached to the underlying host keyboard.

FIG. 3*d* is a side view of the keys of the invention both black and white attached to an underlying host keyboard with a second keyboard instrument added to the arrangement.

FIG. 3*e* is a side view of the type of compact keyboard instrument that is a preferred host for the keys of the invention.

FIG. 4 is the front view of the overall arrangement that the keys of the invention facilitates.

FIG. 5*a* is a side view of a variation of a black key of the invention in which an extendable riser section is used.

FIG. 5*b* is a side view of a variation of a white key of the invention also using an extendable riser section.

Figure 9A:
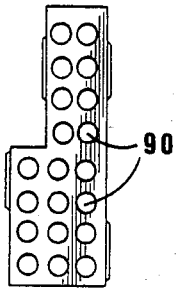

FIG. 9*a* is a direct view of the underside of a white key of the invention employing suction pads as additional means of attachment.

Figure 9B:
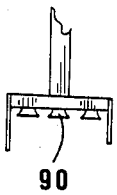

FIG. 9*b* is a front view of the lower section of a white key of the invention employing suction pads as additional means of attachment.

In more detailed reference to the drawings FIG. 1 is a perspective view showing the basic arrangement that the keys of the invention facilitates. The host keyboard instrument is seen at 30. The general dimensions of this instrument make it of the preferred type. Of particular interest is the compact overall height of the instrument's outer shell seen at 87. This distance is often only a few inches in contemporary instruments. The compact height of such host instruments enhances the workability of the invention since compact height in the keys of the invention is consequently possible.

Longer heights in the keys of the invention are certainly possible as will be shown later in the specification, but for the basic version of the invention minimized heights in the riser section offer two advantages. One advantage is that the reduced weight of a shorter overall key will cause less interference with inherent balance of the key mechanisms of the host keyboard. The need for counter-balancing adjustments in the host keyboard may therefore be avoided or minimized in most cases.

The second advantage is that the stability during use of the installed key of the invention is greater when the overall height of the key is minimized.

The host instrument 30 with its host keyboard 38 is in this case essentially the same instrument as 33 with its host keyboard 67. The instrument 33 acts as the upper keyboard in this multi-leveled keyboard arrangement.

The various parts of the invention proper are designated at 3, 8, 5, and 9. At 3 is shown the base of a white key of the invention resting directly on top of its host key 37. The base portion 3 is securely but removably attached to its underlying host key 37. At 8 is seen the riser portion of the white key of the invention. The riser 8 is permanently and rigidly secured to the base portion 3. At 5 is seen the touchplate surface of the white key of the invention. At 9 is the touchplate surface of a black key of the invention. Its lower segments are not visible in this drawing.

The riser 8 is high enough to allow the key of the invention to overcome the vertical distance between the host keyboard 38 and the upper keyboard 67 when these two compact instruments are stacked one above the other.

Figure 1A:
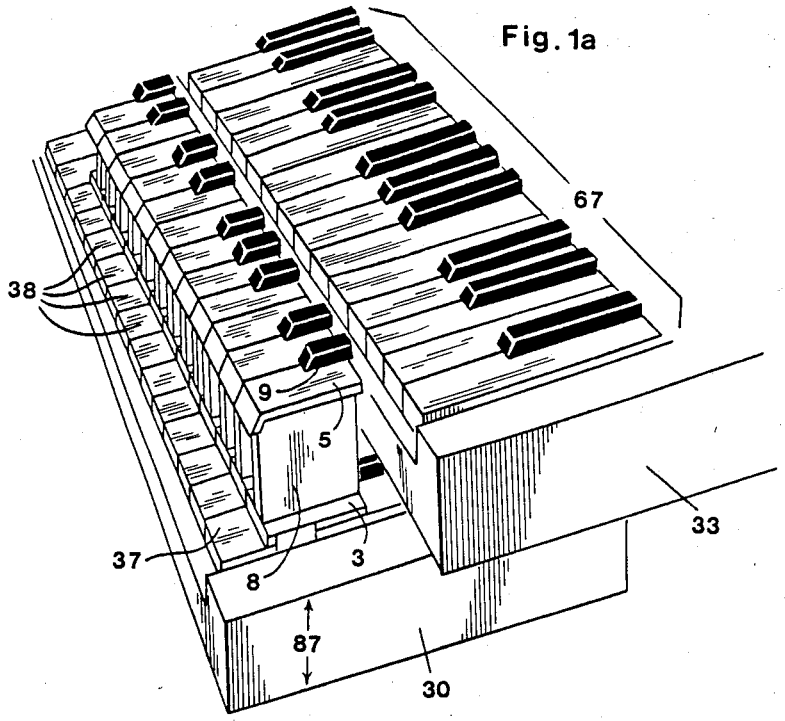
Figure 1B:
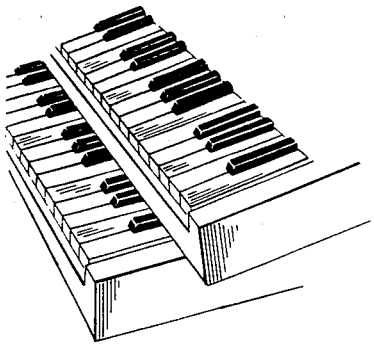

FIG. 1*b* shows the same perspective view as FIG. 1*a* except that the keys of the invention are not in place.

Figure 2:
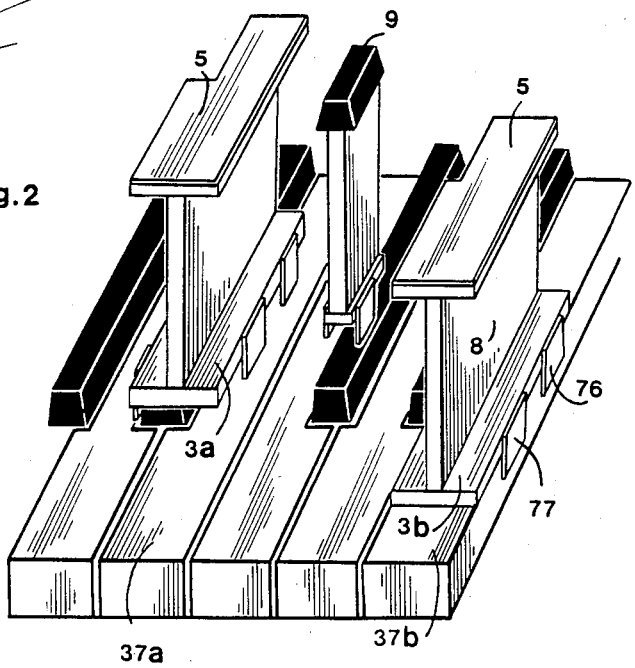

FIG. 2 shows a perspective view of individual keys of the invention both attached and unattached to their corresponding host keys. At 3*a* is a base portion of a white key of the invention in unattached position slightly above its underlying host key 37*a*. At 3*b* is the base portion of another white key of the invention directly on top of and attached to its underlying host key 37*b*. At 5 are the touchplate surfaces of the white keys of the invention and at 9 is a touchplate surface of a black key of the invention.

At 76 and 77 are the vertically positioned thin springy clips that are permanently fixed to the base 3*b* and serve to securely but removably attach the key of the invention to its host key 37*b*.

Figure 3E:
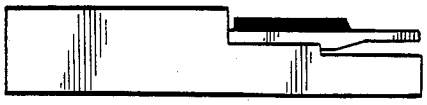
Figure 3A:
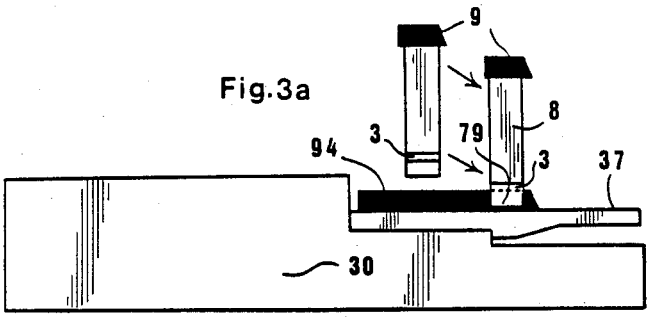

FIG. 3*a* is a side view of black keys of the invention. both attached and unattached to the underlying host black keys 94. At 79 are the side clips of the keys of the invention. At 3 is the base of the key. At 8 is the riser section. At 9 are the touchplate surfaces of the black keys of the invention.

Figure 3B:
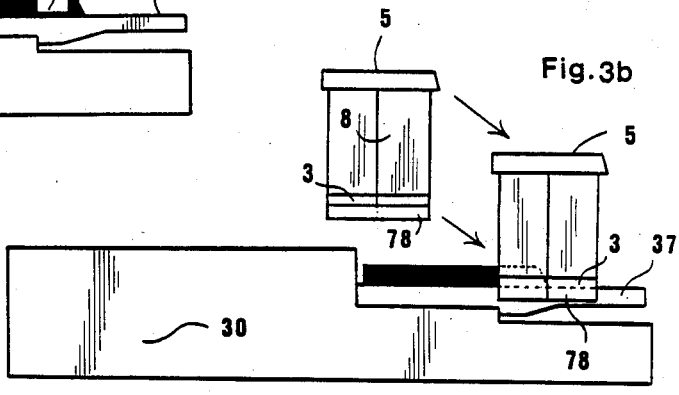

FIG. 3*b* is a side view of white keys of the invention both attached and unattached to the underlying host white key 37. At 3 are the base segments. At 8 is a riser segment. At 5 is the touchplate surface of the invention. At 78 are the side clips of the invention. At 30 is the host keyboard instrument.

Figure 3C:
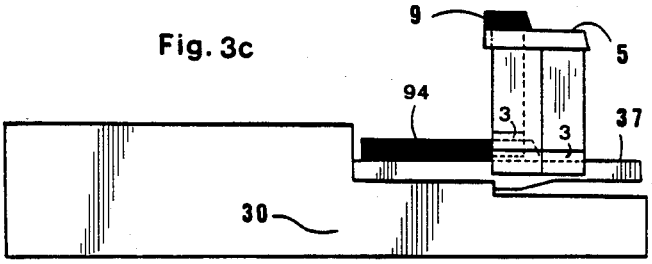

FIG. 3*c* is a side view showing both the white and black keys of the invention in place upon a host black key 94 and a host white key 37 respectively. At 3 are the base segments of the invention resting directly on top of the underlying host keys. The vertical spacing relationship between the upper surfaces of the black and white keys of the invention are normal.

Figure 3D:
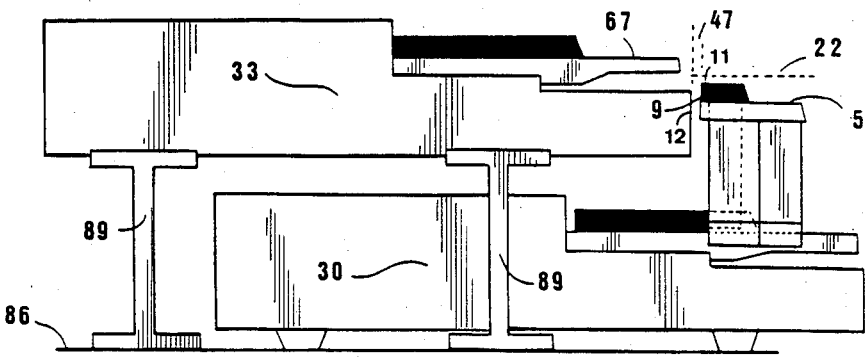

FIG. 3*d* is a side view of the essential arrangement of keyboard instruments that the keys of the invention facilitates. The impotant consideration here is the close proximity of the touchplate surfaces of the keys of the invention to the touchplate surfaces of the upper keyboard 67.

The dotted line 22 represents the horizontal plane upon which the touchplate surface of a white key of the upper keyboard will rest when it is being actuated. It can be seen that this plane is only slightly above the touchplate surface of the unactuated black key of the invention. This positioning allows for proper finger clearance during performance. Nevertheless the distance between black key touchplate surface 9 and 22 is not so great that ackwardness is created for one hand trying to span both keyboards.

As in the other drawings 33 is the upper keyboard instrument and 30 is the host keyboard instrument. At 89 is seen a rigid support means that holds the upper keyboard instrument 33 in proper position. The rigid support means rests on a solid base for the whole arrangement 86.

In addition, the horizontal distance 47 between the front edge of the upper keyboard 12 and the back edge of the keys of the invention 11 is as close as possible without creating friction during use. This distance can be easily adjusted with the placement of the rigid support means 89.

FIG. 3*e* is an isolated side view of a preferred type of contemporary compact keyboard instrument before any keys of the invention have been added.

Figure 4:
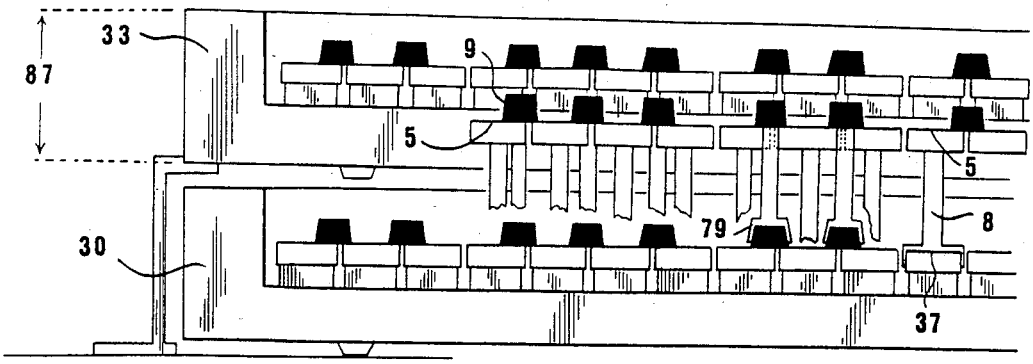

FIG. 4 is the front view of the essential arrangement of keyboards that the keys of the invention facilitate. As in the other drawings 30 is the host keyboard instrument, 33 is the upper keyboard instrument, 5 is the touchplate surface of a white key of the invention, 9 is the touchplate surface of a black key of the invention, 8 is the riser segment, 79 is the clip means of attachment for the white key of the invention and 37 is the host white key.

Also at 87 is again seen the overall height of the compact keyboard instrument used. This distance will typically be only a few inches in most cases.

Figure 5A:
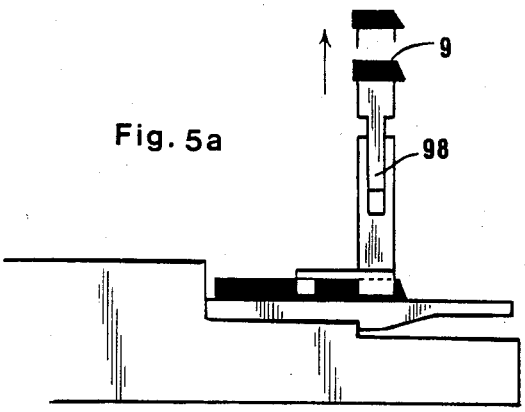

FIG. 5*a* is a side view of a variation of the black key of the invention. In instances when a less compact keyboard instrument is used as the upper keyboard the riser segment of the key of the invention will need to overcome a greater height difference between the upper keyboard involved and the host keyboard.

At 98 is seen an adjustable slider section of the key of the invention that allows for various vertical positionings of the touchplate surface of the black key of the invention.

Figure 5B:
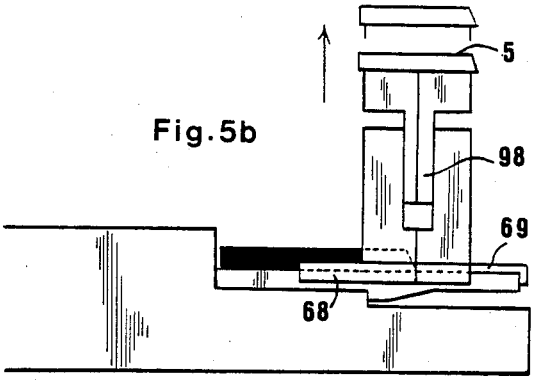

FIG. 5*b* is a side view of the same variaton of a white key of the invention following the same considerations as in FIG. 5*a*.

Figure 6:
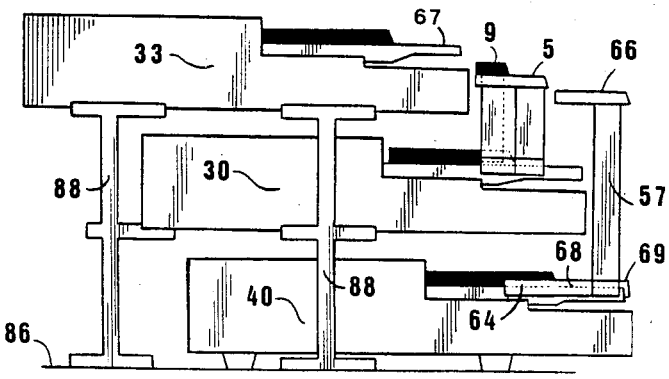
FIG. 6 is a side view of an arrangement of three keyboard instruments representing a more complicated use of the basic concept of the invention. In this case both of the lower keyboards have keys of the invention attached to them.

FIG. 6*a* is a side view of a more complicated application of the invention. Here we see three compact keyboard instruments suspended one above the other by a rigid support means 88 able to hold up two different keyboards on different levels. The arrangement of keyboards here is the same as the basic arrangement described in FIGS. 1, 3*d*, 4 etc. except that an additional lower host keyboard has been added.

Attached to a white key of the new lower host keyboard 68 is an increasingly extended version of the white key of the invention with its various parts seen at 69, 57, 64, and 66. At 64 is the base of the varied key of the invention. The base segment is extended horizontally at the rear in order to provide greater area of contact with the underlying host key. This segment increases the stability of the upper segments of the extended key which may be required when the riser segment is of a greater height as represented at 57. Likewise the base segment is extended at the front 69 in order to provide clip means of attachment over the vertical front face of the host key.

The increased height of the riser segment 57 is required to overcome the increased vertical distance between the touchplate surface of the invention 5 and the touchplate surface of the lowermost host keyboard 68. At 66 is seen the touchplate surface of the increasingly extended key of the invention. It sits at a point sufficiently below the touchplate surface 5 to provide proper finger clearance during use. Nevertheless touchplate surface 66 is still high enough to make simultaneous one hand access to all touchplate surfaces 66, 5, 9, and 67 easy.

It should be added that the significant shortening of the lengths of the keys of the invention 9, 5, and 66 contributes to the ability of one hand to span all the key surfaces, particularly when a third level of keys of the invention is added.

Figure 7:
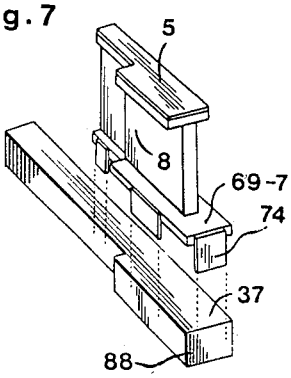
FIG. 7 is a perspective view of an individual white key of the invention with an additional clip at the front.

In FIG. 7 is shown a perspective view of the more complicated clip means of attachment employing a forwardly projecting segment 69-7 that allows for a front clip 74 that fits over the vertical front face of the keyboard 88.

Figure 8:
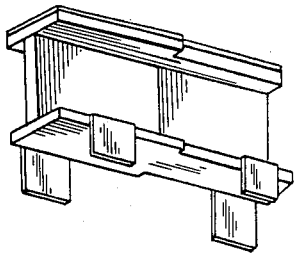
FIG. 8 is a perspective view of a single white key of the invention.

FIG. 8 is a perspective view of a single white key of the invention.

In FIG. 9*a* is seen a view of the underside of a white key of the invention fitted with a set of suction pads 90. This will provide additional strength of attachment and therefore, additional support to the upper segments of the keys of the invention, especially those versions of the invention involving extended riser segments as in FIG. 6, FIG. 5*a* and FIG. 5*b*.

FIG. 9*b* shows a front view of the lower segment of a white key of the invention using suction pads as additional means of attachment. Suction pads are at 90.

In describing the preferred embodiment of the invention ilustrated in the above drawings, specific terminology was resorted to and for the sake of clarity. However, it is not intended to be limited to the specific terms so selected and it is to be understood that each specific term includes all technical equivalents which operate in a similar manner to accomplish a similar purpose.

I claim:

1. In a key type for musical keyboards, a set of vertically extended auxiliary snap-on keys intended for individual placement on top of corresponding host keys in conventional musical keyboards, said snap-on keys consisting of a plurality of key caps both black and white being substantially the same lateral mensuration as their intended host keys but considerably shorter than the latter, each of said key caps having fixed to its underside a support structure that provides significant vertical extension in a downward direction, each of said extending structures further being provided with at their bases means of attachment whereby they can be easily and removably secured into positions directly on top of their corresponding host keys.

2. In a key type for musical keyboards, a set of vertically extended auxiliary snap-on keys intended for individual placement on top of corresponding host keys in conventional musical keyboards, said snap-on keys consisting of a plurality of key caps both black and white being substantially the same lateral mensuration as their intended host keys but considerable shorter than the later, each of said key caps having fixed to its underside a support structure that provides significant vertical extention in a downward direction, said support structure including means for variable and securable lengths of vertical extention, each of said extending structures further being provided with at their bases means of attachment whereby they can be easily and removably secured into positions directly on top of their corresponding host keys.

* * * * *